United States Patent [19]

Bretschneider

[11] 4,212,178

[45] Jul. 15, 1980

[54] ROLLING MILL

[75] Inventor: Erich Bretschneider, Meerbusch, Fed. Rep. of Germany

[73] Assignee: Schloeman-Siemag Akt., Düsseldorf, Fed. Rep. of Germany

[21] Appl. No.: 3,632

[22] Filed: Jan. 15, 1979

Related U.S. Application Data

[63] Continuation of Ser. No. 862,857, Dec. 21, 1977, abandoned.

[30] Foreign Application Priority Data

Dec. 21, 1976 [DE] Fed. Rep. of Germany ..... 2657823
Dec. 21, 1976 [DE] Fed. Rep. of Germany ..... 2657839

[51] Int. Cl.[2] ..... B21B 17/06; B21B 1/00; B21B 39/00

[52] U.S. Cl. ..... 72/97; 72/234; 72/250

[58] Field of Search ..... 72/234, 68, 209, 200, 72/208, 97, 227, 250–252, 366, 370, 78, 96

[56] References Cited

U.S. PATENT DOCUMENTS

| | | | |
|---|---|---|---|
| 1,980,368 | 11/1934 | Bark et al. | 72/234 X |
| 3,673,836 | 7/1972 | Petersen et al. | 72/78 |
| 3,718,020 | 2/1973 | Leitner | 72/78 |
| 3,735,617 | 5/1973 | Breitschneider | 72/78 |

FOREIGN PATENT DOCUMENTS

| | | | |
|---|---|---|---|
| 634534 | 8/1936 | Fed. Rep. of Germany . | |
| 635015 | 9/1936 | Fed. Rep. of Germany | 72/97 |
| 1280187 | 10/1968 | Fed. Rep. of Germany . | |
| 1602135 | 5/1973 | Fed. Rep. of Germany . | |
| 2418454 | 11/1975 | Fed. Rep. of Germany . | |
| 582859 | 10/1934 | France . | |
| 292115 | 9/1928 | United Kingdom . | |

OTHER PUBLICATIONS

"Current Trends in Seamless Tube Mill Design"—Schuetz & Brown, Iron & Steel Engineer, Sep., 1976.
Iron & Steel Engr., Oct., 1966, pp. 124–134.
Klepzig Professional Journal, 81st Ed., 1973, pp. 218–221.
Stahl und Eisen, 93rd Ed., 1973, pp. 1024–1029.

*Primary Examiner*—Milton S. Mehr
*Attorney, Agent, or Firm*—Norman S. Blodgett; Gerry A. Blodgett

[57] ABSTRACT

Rolling mill for forming seamless pipes from round billets, comprising a rotary piercing mill or a punch press for shaping billets into hollow blocks, a cross conveyor leading to a planetary rolling mill for the rolling of the hollow blocks on a mandrel into seamless pipe, followed by stretch-reducing rolling mill for rolling the seamless pipes into a finished product.

4 Claims, 3 Drawing Figures

Fig. I

ROLLING MILL

This is a continuation of application Ser. No. 862,857 filed Dec. 21, 1977, abandoned.

BACKGROUND OF THE INVENTION

Rolling mills for forming seamless tubing have taken various forms. These mills differ generally in the arrangement and design of the rolling mill for the pre-rolling of hollow blocks to pipes arranged between the rotary piercing mill (or punch press) and the stretch-reducing rolling mill.

In a classic design of a pipe rolling mill, the mill is equipped with a multi-stand continuous rolling mill to which the hollow blocks are delivered as they come from the rotary piercing mill or the punch press.

If the round billets are provided with a bore in a rotary piercing mill to form the hollow blocks, then these hollow blocks must be delivered to the continuous rolling mill by a cross coneyor. The rotary piercing mill usually works with a mandrel arranged on the exit side of the mill; the round billets are formed into hollow blocks by rotating the billet about its longitudinal axis on the mandrel. The rotary piercing mill does not permit immediate introduction of the hollow block into the continuous rolling mill with a mandrel arranged on the outlet end, because the mandrel has to be removed from the block after the rolling operation. Even in the case where the mandrel does not have to be removed at the outlet side, the hollow block would not be able to move directly into the continuous rolling mill, because it rotates about its axis during the shaping operation in the rotating piercing mill; such rotation is not desirable in the continuous rolling mill.

The deformation of the hollow block within the continuous rolling mill takes place on a mandrel which is introduced into the hollow block in front of the continuous rolling mill, the mandrel moving along with the block in the direction of rolling during the operation of rolling the seamless pipes. For this reason, the mandrel must have a length corresponding at least to the length of the seamless pipe.

In a rolling mill equipped with a continuous rolling mill, it is also necessary to provide a mandrel-removal device on the exit side of the continuous rolling mill. With the help of this device, the mandrel is removed after the seamless pipe leaves the continuous rolling mill, the mandrel being carried back to the entrance side of the continuous rolling mill for re-use.

The presence of the mandrel-removal device makes it impossible to arrange the continuous rolling mill and the stretch-reducing rolling mill which follows it along one rolling line. For this same reason the seamless pipes have to be moved on a cross conveyor located after the continuous rolling mill to bring them to the entrance to the stretch-reducing rolling mill. Because of the relatively long path taken by the pipes in passing through the continuous rolling mill and the following mandrel-removal device, the seamless pipe cools off to an approximate temperature of 650° C., so that it has to be reheated before introducing it to the stretch-reducing rolling mill. For this purpose, a reheat furnace is located after the cross conveyor in these known rolling mill plants to heat the seamless pipes before they can be introduced into the stretch-reducing rolling mill. It can be clearly seen that a rolling mill of the type described is very expensive, because it requires, in addition to the different rolling mills, expensive auxiliaries, so that the plant can only be housed in long, wide buildings. In addition, the weight of the round billets that can be used for making the pipe is limited, because the seamless pipes (as intermediate products) cannot exceed a maximum length of 30 meters, based on the design of the auxiliary devices.

A completely continuous fabrication of seamless tubing with such a rolling mill plant, as described for example in the "Klepzig Professional Journal" 81st year 1973, pages 218–221, is not possible.

To reduce the cost of the plant, a suggestion was made in the periodical "Stahl & Eisen" 93rd year, 1973, page 1026 in the right hand column, to locate a planetary rotary piercing mill in place of the multi-stand continuous rolling mill. In general, there would be no change in the general design of the rolling mill, because it is evident that the rolling of seamless pipes must also be made on a following mandrel; consequently, the mandrel-removal device, the added cross conveyor, and the reheat furnace located ahead of the stretch-reducing rolling mill must still be present.

Rolling mills for the fabrication of seamless pipes made from round billets are also known in which a so-called "Assel" rolling mill is provided with the rotary piercing mill for the fabrication of hollow blocks. On the "Assel" rolling mill, the re-shaping of the hollow blocks into seamless pipes is also performed on a mandrel, but located at the inlet side. During the rolling operation, the stock rotates about its longitudinal axis and the mandrel partakes of this rotation.

In order to fabricate seamless pipes on an Assel rolling mill, a mandrel-removal device is not required, but in this case the seamless pipe also cannot run directly into the stretch-reducing rolling mill, mainly because rotational movement of the pipe is undesirable in the stretch-reducing rolling mill. Therefore, the Assel rolling mill must also be used with a cross conveyor and a reheat furnace, so that the cost in such case is still quite high.

In the Assel rolling mill, the necessity of supporting the mandrel at the entrance side creates considerable difficulties, because it rotates with the rolling stock and, therefore, must be supported by expensive bearings capable of absorbing axial forces.

To complete the discussion of the prior art, it should be mentioned that there is a so-called "reciprocating" rolling process mill available for the fabrication of seamless pipes. The type of operation is somewhat between that of the two previously-described rolling mill types, because the rolling stock does not rotate continuously but is turned intermittently. Also, pipes coming from the reciprocating rolling mill cannot go directly into the stretch-reducing rolling mill arranged after it.

It is, therefore, an outstanding object of the invention to do away with the disadvantages of all the previously-described rolling mills for the fabrication of seamless pipes from round billets. Therefore, it is the purpose of this invention to create a rolling mill of the previously-described type for fabrication of seamless pipes from round billets in which the hollow blocks which have been formed in a rotary piercing mill (or on a punch press) are rolled continuously and with one heating into the finished product. At the same time, the weight of the individual round billets can be increased, so that the production of this rolling mill is improved correspondingly.

A further purpose of this invention is to simplify even more the operating procedure of a pipe rolling mill plant by replacing the continuous rolling mill for rolling of seamless pipe with a planetary rotary piercing mill; therefore, it is a purpose of this invention to equip the planetary rotary piercing mill for continuous rolling of pipe billets to seamless pipes in such a way that at least the commonly-used mandrel pullout device is eliminated.

These and other difficulties experienced with the prior art devices have been obviated in a novel manner by the present invention.

With these and other objects in view, as will be apparent to those skilled in the art, the invention resides in the combination of parts set forth in the specification and covered by the claims appended hereto.

SUMMARY OF THE INVENTION

In general, the solution to this complex problem is achieved in the present invention by designing the seamless rolling mill as a planetary rotary piercing mill with a mandrel arranged on its inlet side which penetrates the blank during the rolling operation with the mandrel rod extending into and fixed at the deformation zone, the planetary rolling mill being arranged in line with and closely coupled to a stretch-reducing rolling mill.

Since the rotation of the seamless pipe (on one hand) is prevented in such a rolling mill during the rolling operation and since the mandrel (on the other hand) has a stationary position, the seamless pipe may run out of the rotary piercing mill without interruption and directly into the stretch-reducing rolling mill. Since the seamless pipe is exposed to the reducing operation within the rotary piercing mill for a relatively short period (because of the short distance) and because of the mandrel being locked in place at the entrance, a mandrel-removal device is not required. Consequently, a cross conveyor as well as a reheat furnace are not required. Based on the recognition of these facts, a further characteristic of the invention is the arrangement of the rotary piercing mill directly in front of the stretch-reducing rolling mill. This method has the advantage that the building in which the rolling takes place can be kept shorter as well as smaller.

In order that a satisfactory operation of the planetary rotary piercing mill can be guaranteed during the rolling of hollow blocks into seamless pipe, a further characteristic of this invention is to make it possible to displace the mandrel axially for the length of a hollow block at the entrance side of the planetary rolling mill. By means of this arrangement, the hollow block can be transported by a cross conveyor from the rotary piercing mill (or punch press) to the front of the planetary rotary piercing mill, whereupon the mandrel with its tip is pushed through the hollow block into the deformation zone of the planetary rotary piercing mill. By a subsequent feed movement of the hollow block, its front end is pushed into the deformation zone of the planetary rotary piercing mill and is continuously formed into a pipe at that place over the fixed mandrel tip with a considerable degree of stretch and in a single rolling path; the pipe that is so formed runs directly thereafter into the stretch-reducing mill for the formation of the finished pipe.

This method has the advantage that only the mandrel has to be inserted before the entrance of the pipe billet into the planetary rotary piercing mill and that the rolling of the pipe billet to a seamless pipe within the planetary rotary piercing mill is made on the fixed mandrel tip. A further characteristic of this invention is that an adjustable feeding device for the pipe billets is arranged at the entrance side and is concentric to the centrally-located rolling stock guide sleeve. With the help of this feeding device, the front end of the pipe billet can be pushed over the mandrel tip into the planetary rotary piercing mill, whereupon this planetary rotary piercing mill forces the further advance movement of the pipe billet, so that it is automatically removed from the mandrel. It has been proven to be practical to design the feed device as a pipe plunger within the central guide pipe of the mill. Since such a rolling mill plant prevents the rotation of the seamless pipe during the rolling operation (on the one hand) and (on the other hand) the mandrel has a fixed position, the seamless pipe may run without any interruption from the planetary rolling mill into the stretch-reducing rolling mill.

Since the seamless pipe is exposed for a relatively short distance within the planetary rotary reducing mill for the deformation operation and because of the mandrel rod is fixed at the inlet side, a mandrel pull-out device is not required at the exit side, a cross conveyor is not required, and a reheat oven is also not necessary. Therefore, according to a further characteristic of this invention, the planetary rotary piercing mill may be arranged directly in front of the stretch-reducing rolling mill and forms therewith a complete, continuous pipe rolling plant. Consequently, the advantage is that the rolling building may be built considerably shorter and smaller.

So that a satisfactory operation of the planetary rotary piercing mill during rolling of hollow billets to seamless pipes can be secured, a further characteristic of this invention is to arrange the mandrel rod on the entrance side, so that it is displaceable in the axial direction for a length at least as long as the hollow billets. By this arrangement, the hollow billets may be brought from the rotary piercing mill (or from the hole press) by a cross conveyor device to the entrance side of the planetary rotary piercing rolling mill and the mandrel rod with its mandrel tip may be pushed forward through the hollow billet into the deformation zone of the planetary piercing rolling mill. By a following feed of the hollow billet, its front end is brought into the deformation zone of the planetary rotary piercing mill, and there the pipe is formed continuously with a large degree of stretch by one rolling pass over the fixed mandrel tip, and thereafter runs directly into the stretch-reducing rolling mill for fabrication of the finished pipe.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 3:
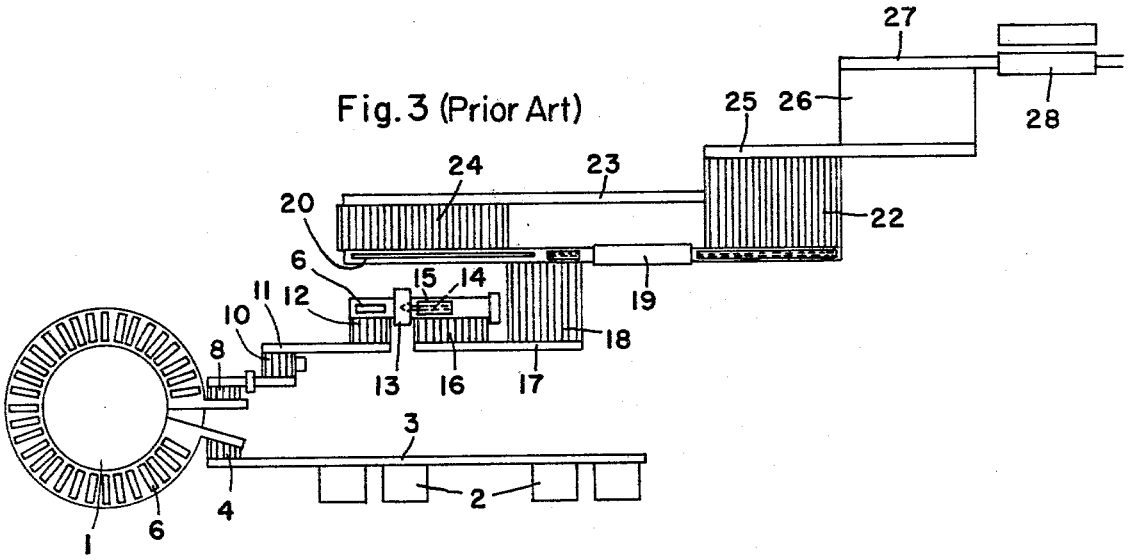
Fig. 3 (Prior Art)
FIG. 3 is a schematic plan view of a conventional tube rolling milling mill plant with a continuous rolling mill located between a rotary piercing mill and a stretch-reducing rolling mill.

Referring to FIG. 3, which shows a conventional plant, a billet furnace 1 is supplied step-wise with round billets 6 at the inlet from a storage area 2, for example, on a roller conveyor 3 and a cross conveyor 4. After reheating, the billets 6 are discharged similarly step-wise from the turnable billet furnace 1 at the exit. From there, the billet is transported over a cross conveyor 8 into a centering device and from there again over a cross conveyor 10, roller conveyor 11, and cross conveyor 12 to the front of the entrance to a rotary piercing mill 13. In this rotary piercing mill, the round billets 6 are formed into the hollow blocks 15 in the known manner on a mandrel 14 held at the outlet side. After the hollow block 15 has completely left the rotary piercing mill 13, the mandrel 14 will be pulled out from the hollow block 15 from the outlet side. From there the hollow block 15 is again transported to a cross conveyor 16 and a roll conveyor 17 to another cross conveyor 18. In the pipe rolling mill plant of FIG. 3, the hollow block 15 is delivered by the cross conveyor 18 to the front of a multistand continuous rolling mill 19. At this position, a long mandrel rod 20 is pushed through the back end of the hollow block 15 and the hollow block with the mandrel rod 20 runs into the continuous rolling mill 19.

The hollow block 15 will be rolled to a seamless pipe 21 on the mandrel 20. The seamless pipe now arrives at a cross conveyor 22 and is brought by it to the front of a mandrel rod pull-out device 23. The mandrel rod pull-out device removes the mandrel from the seamless pipe 21 and transports the mandrel back over a cross conveyor 24. By means of the cross conveyor 24, the mandrel rod 20 is returned to the front of the entrance to the continuous rolling mill 19. The stripped seamless pipe is moved further until it reaches a reheat furnace 26 on a roll conveyor 25, because in the meantime the pipe has cooled down to approximately 650° C.

Within the reheat furnace 26 the seamless pipe 21 is heated up again to 950° C. From there on, the seamless pipe arrives on a roll conveyor 27 at a stretch-reducing rolling mill 28 with a large number of rolling stands and is rolled in the mill 28 to the final wall thickness and required diameter.

It is quite clear that a pipe-rolling mill constructed in accordance with the FIG. 3 is very expensive and can be operated only with a limited number and weight of round billets 6, because of the complicated working operation. In addition, the mandrel rod pull-out device 23 causes considerable noise and causes the seamless pipes 21 to be cooled to a temperature which requires a reheating before the seamless pipe goes into the stretch-reducing rolling mill 28.

Figure 1:
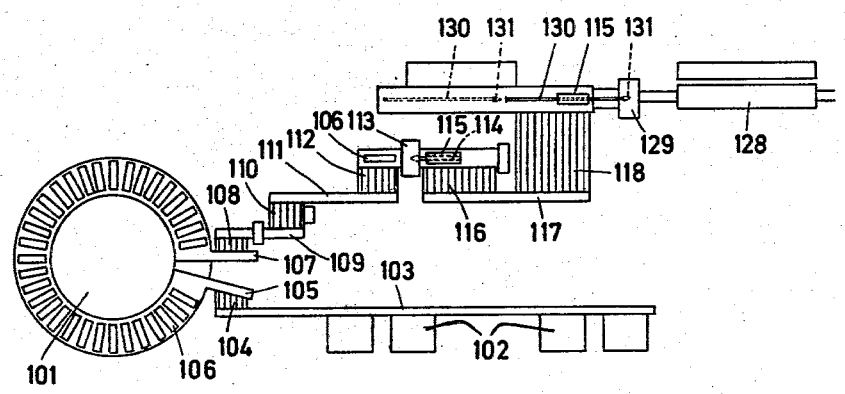
FIG. 1 is a schematic plan view of a pipe rolling mill constructed in accordance with the principles of the present invention.

Referring to FIG. 1 of the drawing, a revolving billet furnace 101 is supplied step-wise with round billets 106 at the inlet side 105 from a storage location 102, for example, by a roll conveyor 103 and a cross conveyor 104. After reheating, the billets are discharged also stepwise from the turnable billet oven 101 at the exit 107. From there they are transported over a cross conveyor 108 into a centering device 109 and from there again over cross conveyors 110 and 112 as well as a roll conveyor 111 to the front of the entrance of a rotary piercing mill 113. In this rotary piercing mill 113, the round billets 106 are formed into hollow blocks 115 in the known manner over a mandrel 114 held at the outlet side. After the hollow block 115 has completely left the rotary piercing mill 113, the mandrel 114 will be pulled out from the hollow block 115 from the outlet side. From here on, the hollow block 15 is again transported by a cross conveyor 116 and a roll conveyor 117 to another cross conveyor 118.

In the pipe rolling mill shown in FIG. 1, a planetary rotary piercing mill 129 similar to that shown in U.S. Pat. No. 3,718,020 and 3,735,617, is substituted for the multi-stand continuous rolling mill. By means of a cross conveyor 118, the hollow block 115 is delivered to the entrance side of the planetary rolling mill 129. At this point, a mandrel rod 130 is pushed from the rear end through the hollow block 115 with its mandrel tip 131 located in the deformation zone of the planetary rolling mill 129 and fixed in that position. The hollow block 115 is now pushed forward over the mandrel rod 130 so that its front end enters the deformation zone of the planetary rolling mill 129 and is shaped thereby over the stationary mandrel tip 131 with a high degree of stretch into a seamless pipe. Since the path of the hollow blocks 115 through the planetary rolling mill 129 is very short, the seamless pipe runs off freely from the mandrel tip 131 of mandrel rod 130. It may run directly into the stretch-reducing rolling mill 128 and there be rolled to the final wall thickness and the required diameter to the finished pipe without any interruption.

Figure 2:
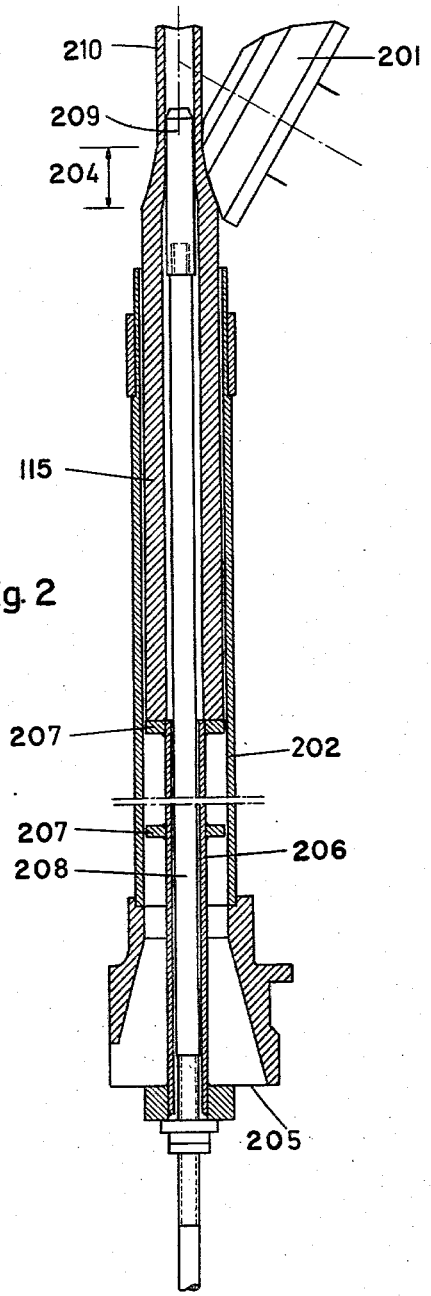
FIG. 2 is a longitudinal sectional view of a planetary pipe rolling mill.

FIG. 2 shows a longitudinal section of important parts of the planetary rolling mill 129 for continuous rolling of pipe billets to seamless pipes. For simplification, the drawing shows only one of the three rolling heads 201 of the planetary rolling mill. On the entrance side of the planetary rotary piercing mill is mounted a centrally-located guide sleeve 202 through which a pipe billet 115 is introduced into a common zone of the three rolling heads 201. The pipe billet 115 in this arrangement is transported by the common cross conveyor 118 to a position in front of the funnel-shaped entrance 205 of the concentrically-located guide sleeve 202 and, after that, is driven into the center pipe by a feeding device 206. The feeding device 206 is designed as a pipe-shaped plunger and is equipped with a guide means such as ring flanges 207 located within the pipe 202.

A mandrel 208 is introduced into and through the central guide pipe 202, the feed device 206, and the pipe billet 115 and carries on its front end a tip 209 made from a wear-resistant material. The mandrel 208 is of such a length that its tip 209 may be pushed forward within the pipe billet 115 into the common work area or deformation zone 204 of the three roller heads 201. With the tip 209 in this position, the mandrel 208 is fixedly clamped against axial movement, so that the roller heads 201 rotating around the rolling axis of the planetary rotary piercing mill act to roll the pipe billet 115 slowly into a seamless pipe by axial stretching and simultaneous cross-sectional reduction over the fixed mandrel tip. As soon as the rear-end of the seamless pipe 210 exits from the planetary rolling mill, it is also released from the mandrel 208 and the mandrel tip 209.

The mandrel 208 and feeding device 206 may be pulled out of the planetary rolling mill towards the entrance side of the central guide pipe 202 for the purpose of initiating a new rolling operation; they are pulled far enough out that the next pipe billet 203 can be delivered to a position in front of the funnel-shaped entrance side 205 of the central guide pipe 202 to start another working cycle.

The rolling of the hollow blocks 115 coming from the planetary rolling mill 129 is in this case completely continuous, that is to say, without any interruption and with a single rolling heating. By the use of the planetary rotary piercing mill 129 with the stationary fixable mandrel rod 130, it is possible to eliminate not only the cross conveyors 22 and 24 and roll conveyors 25 and 27 of FIG. 3, but also the reheat furnace 26. In addition, the charge weights of the round billets 6 may be considerably increased, for example, to three times as much, because the pipes, being produced as an intermediate product of the planetary rolling mill 129, are not rolled on a revolving mandrel rod. By increasing the weights of the round billets, the amount of finished pipe produced is considerably improved.

Finally, it should be mentioned that continuously cast blocks of octagon shape can be used as charge billets. They would not be rolled by the rotary piercing mill 113 to hollow blocks 115 but would be penetrated by a hole press or punch press. Such octagon-shaped blocks may be introduced directly into the planetary rotary piercing mill 29 and rolled out over a stationary mandrel rod 130 positioned at the inlet.

A further advantage of the planetary rolling mill 129 with fixed mandrel rod 130 at the entrance is in that it operates with a degree of reduction of 12, as compared to an eight-stand continuous rolling mill which achieves only a reduction of 4. By using the planetary rolling piercing mill 129, it is possible to achieve in addition a high degree of surface quality on the seamless pipes in the intermediate stage.

It is obvious that minor changes may be made in the form and construction of the invention without departing rom the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Seamless tube rolling mill, comprising:

(a) a reheat furnace for billets, (b) a piercing mill for forming a longitudinal bore through the billet, (c) a first longitudinal conveyor extending in spaced, parallel relationship to the axis of the piercing mill at the exit side thereof, (d) a cross conveyor extending from the said longitudinal conveyor to a second longitudinal conveyor, (e) a planetary rolling mill located at the discharge end of the second longitudinal conveyor and include a guide sleeve for carrying the billet, a concentric mandrel adapted to extend through the bore in the billet and carried for longitudinal movement relative to the planetary rolling mill, means locking the mandrel in place when its downstream end reaches the work area of the mill, and a tube-like feed device slidably carried in the space between the mandrel and the guide sleeve for pushing the billet along the mandrel and through the said work area, and (f) a stretch-reducing rolling mill mounted adjacent to and in line with the exit of the planetary rolling mill to receive the billet as it emerges therefrom.

2. Seamless tube rolling mill as recited in claim 1, wherein the planetary rolling mill is provided with a cluster of generally-conical rolls whose axes lies at a substantial angle to the axis of the mandrel.

3. Seamless tube rolling mill as recited in claim 1, wherein the guide sleeve and mandrel are restrained against rotation.

4. Seamless tube rolling mill comprising:

(a) a piercing mill for forming a longitudinal bore through a heated billet, (b) a planetary rolling mill spaced from the piercing mill and having an inlet side, an outlet side and a deformation zone between the inlet and outlet sides, (c) an elongated mandrel including a forming tip at one end at the inlet side of the rolling mill, said mandrel being axially aligned with the deformation zone of the rolling mill and movable axially from a first position spaced from the deformation zone to a second fixed position wherein the forming tip extends into the deformation zone, (d) a guide sleeve for the pierced billet located adjacent the deformation zone of the planetary rolling mill, (e) means for positioning the pierced billet between the guide sleeve and the mandrel in its first position so that the mandrel extends through the bore in the billet during movement of the mandrel from its first position to its second positon, and a plunger positioned coaxially of the mandrel and slidable within the guide sleeve relative to the mandrel for feeding the pierced billet through the deformation zone relative to the mandrel.

* * * * *